US011127576B2

(12) United States Patent
Brown et al.

(10) Patent No.: US 11,127,576 B2
(45) Date of Patent: Sep. 21, 2021

(54) AXIAL ATMOSPHERIC PRESSURE PHOTO-IONIZATION IMAGING SOURCE AND INLET DEVICE

(71) Applicant: MICROMASS UK LIMITED, Wilmslow (GB)

(72) Inventors: Jeffery Mark Brown, Hyde (GB); Steven Derek Pringle, Darwen (GB)

(73) Assignee: Micromass UK Limited, Wilmslow (GB)

( * ) Notice: Subject to any disclaimer, the term of this patent is extended or adjusted under 35 U.S.C. 154(b) by 35 days.

(21) Appl. No.: 16/462,001

(22) PCT Filed: Nov. 17, 2017

(86) PCT No.: PCT/GB2017/053463

§ 371 (c)(1),
(2) Date: May 17, 2019

(87) PCT Pub. No.: WO2018/091910

PCT Pub. Date: May 24, 2018

(65) Prior Publication Data

US 2019/0326108 A1 Oct. 24, 2019

(30) Foreign Application Priority Data

Nov. 17, 2016 (GB) ..... 1619477

(51) Int. Cl.
*H01J 49/00* (2006.01)
*H01J 49/04* (2006.01)
*H01J 49/16* (2006.01)

(52) U.S. Cl.
CPC ..... *H01J 49/0404* (2013.01); *H01J 49/0059* (2013.01); *H01J 49/0463* (2013.01); *H01J 49/164* (2013.01)

(58) Field of Classification Search
USPC ..... 250/288
See application file for complete search history.

(56) References Cited

U.S. PATENT DOCUMENTS 4,988,879 A * 1/1991 Zare ..... H01J 27/24 250/282
5,171,989 A * 12/1992 Williams ..... H01J 49/0404 250/288

(Continued)

FOREIGN PATENT DOCUMENTS

EP 2363877 A1 9/2011
GB 2177507 A 1/1987

(Continued)

OTHER PUBLICATIONS

International Search Report and Written Opinion for International Patent Application No. PCT/GB2017/053463 dated Apr. 13, 2018, 19 pages.

(Continued)

*Primary Examiner* — Phillip A Johnston
(74) *Attorney, Agent, or Firm* — Kacvinsky Daisak Bluni PLLC

(57) ABSTRACT

An ambient or atmospheric pressure ion source is disclosed that comprises a laser source (1) that generates ions and/or neutral particles from a target (2). A transfer device (10) causes the ions and/or neutral particles to pass along a first path or axis within the transfer device (10), while a secondary activation device (6) directs laser radiation or photons along, across or over at least a portion of the first path or axis to cause secondary activation of the ions and/or neutral particles.

16 Claims, 1 Drawing Sheet

(56) References Cited

U.S. PATENT DOCUMENTS

| | | | | |
|---|---|---|---|---|
| 5,313,067 | A | 5/1994 | Houk et al. | |
| 5,663,561 | A * | 9/1997 | Franzen | H01J 49/0463 250/282 |
| 6,747,274 | B2 * | 6/2004 | Li | H01J 49/107 250/287 |
| 8,384,023 | B2 * | 2/2013 | Schultz | H01J 49/107 250/287 |
| 8,829,426 | B2 * | 9/2014 | Vertes | H01J 49/0463 250/282 |
| 2003/0155505 | A1 | 8/2003 | Russ, IV et al. | |
| 2006/0071160 | A1 | 4/2006 | Haase et al. | |
| 2009/0039282 | A1 | 2/2009 | Haase et al. | |
| 2010/0224775 | A1 | 9/2010 | Haase et al. | |
| 2011/0121173 | A1 | 5/2011 | Koenig et al. | |
| 2013/0099112 | A1 | 4/2013 | Haase et al. | |

FOREIGN PATENT DOCUMENTS

| | | | |
|---|---|---|---|
| GB | 2422954 | A | 8/2006 |
| GB | 2423187 | A | 8/2006 |
| GB | 2443219 | A | 4/2008 |
| GB | 2453407 | A | 4/2009 |
| GB | 2468394 | A | 9/2010 |
| GB | 2542500 | A | 3/2017 |
| JP | 2014228430 | A | 12/2014 |
| JP | 2014228431 | A | 12/2014 |
| WO | 2008146333 | A1 | 8/2010 |
| WO | 2014114803 | A2 | 7/2014 |

OTHER PUBLICATIONS

Search Report for United Kingdom Application No. GB1619477.1 dated Mar. 9, 2017, 6 pages.

Soltwisch et al., "Mass Spectrometry Imaging with Laser-Induced Postionization", Science, 348 (6231): 211-215, Mar. 5, 2015.

Dreisewerd, K., "The Desorption Process in MALDI", Chem. Rev, 103:395-425 (2003).

* cited by examiner

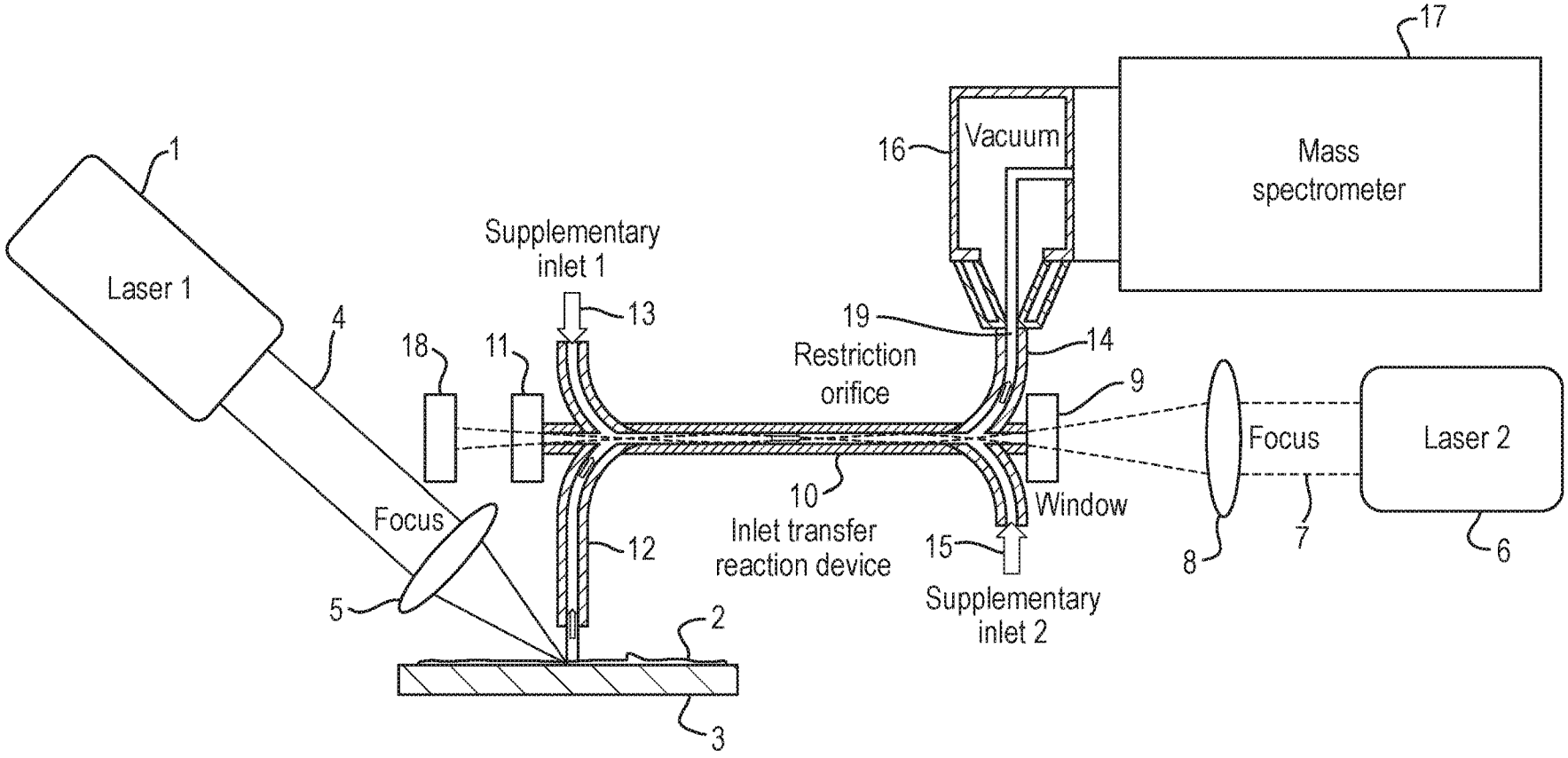
Laser 1
1
4
Focus
5
18
11
Supplementary inlet 1
13
12
2
3
Inlet transfer reaction device
10
Restriction orifice
19
16
Vacuum
14
9
Window
Supplementary inlet 2
15
Focus
8
7
Laser 2
6
Mass spectrometer
17

AXIAL ATMOSPHERIC PRESSURE PHOTO-IONIZATION IMAGING SOURCE AND INLET DEVICE

CROSS-REFERENCE TO RELATED APPLICATION

This application is a national phase filing claiming the benefit of and priority to International Patent Application No. PCT/GB2017/053463, filed on Nov. 17, 2017, which claims priority from and the benefit of United Kingdom patent application No. 1619477.1 filed on Nov. 17, 2016. The entire contents of these applications are incorporated herein by reference.

FIELD OF THE INVENTION

The present invention relates generally to ion sources and in particular to atmospheric pressure photo-ionisation ion sources.

BACKGROUND

Matrix Assisted Laser Desorption Ionisation ("MALDI") mass spectrometry ("MS") is a known process which is particularly suited for the analysis of non-volatile biomolecules. Matrix Assisted Laser Desorption Ionisation mass spectrometry has been shown to be particularly successful in the analysis of large biomolecules in fields such as proteomics. A suitable matrix material (e.g. 2,5-dihydroxybenzoic acid ("DHB"), α-cyano-4-hydroxycinnamic acid ("CCA") or sinapinic acid ("SA") together with an organic base such as pyridine ("Py"), tributylamine ("TBA") or N,N-dimethylethylenediamine ("DMED")) is added to a sample so that the sample becomes embedded in matrix material. The embedded sample is then positioned on a metal plate and a laser pulse is directed on to the target sample. The laser pulse impinging upon the target sample causes analyte material to be ablated and desorbed from the target sample. Analyte ions are generated by analyte material being protonated or deprotonated in the ensuing hot plume of gaseous molecules which is released from the target. A matrix such as sinapinic acid is able to donate protons ($H^+$) to the analyte of interest.

The matrix is ideally arranged to have a relatively strong absorption at the wavelength of the laser pulse and the matrix acts as a proton source to encourage ionisation of the analyte. The gaseous plume which is released from the target comprises a mixture of analyte ions together with neutral particles. The mixture of analyte ions and neutral particles is then directed towards the inlet of a mass spectrometer. Electric fields and gas flow effects may be utilised in order to preferentially separate analyte ions from neutral particles with the analyte ions being onwardly transmitted to a mass analysis section of the mass spectrometer. The analyte ions are mass analysed by a mass analyser and detailed mass spectral information is obtained.

Matrix Assisted Laser Desorption Ionisation mass spectrometry imaging ("MALDI-MSI") involves analysing the distribution of biomolecules across the surface of a target (e.g. a tissue embedded in a matrix) by scanning the target with a focused laser beam and recording the ion profile at each irradiated pixel. An image of the mass spectral properties of the target across the surface of the target can then be constructed.

The techniques of Matrix Assisted Laser Desorption Ionisation and Matrix Assisted Laser Desorption Ionisation mass spectrometry imaging ("MALDI-MSI") suffer from the problem of low ion yields and ion suppression effects. For example, it will be appreciated that a matrix is added to a sample according to conventional methods in order to seek to improve the ionisation efficiency of non-volatile and hence inherently difficult to ionise biomolecules.

It is known to attempt to address the problem of low ion yields which conventional Matrix Assisted Laser Desorption Ionisation and Matrix Assisted Laser Desorption Ionisation mass spectrometry imaging techniques may suffer from by attempting to ionise neutral analyte particles or molecules which are released as part of the MALDI plume using a secondary ionisation or post-ionisation laser source. An arrangement is disclosed in Soltwisch, Kettling, Vens-Cappell, Wiegelmann, Müthing and Dreisewerd "Mass spectrometry imaging with laser-induced postionization." Science, Vol. 348, Issue 6231, pp. 211-215 (2015) which comprises an in-vacuum MALDI ion source wherein a secondary laser beam is focused onto the MALDI plume immediately above and very close to the target. The target is provided within a vacuum chamber which is maintained at a pressure of 2.0-2.5 mbar i.e. at sub-atmospheric pressure. The post ionisation laser which is utilised in the known arrangement is used to induce secondary MALDI like ionisation in the gas phase of neutral particles which are included in the MALDI plume. Operation of the secondary laser is delayed to coincide with the spatial location of the matrix and analyte.

The known arrangement suffers from the problems that firstly, the target sample must be provided within a vacuum chamber of the mass spectrometer which must be maintained at a sub-atmospheric pressure of e.g. 2.0-2.5 mbar and that secondly, the secondary laser beam is aimed very close to the surface of the target.

The known arrangement is, therefore, unsuitable for the analysis of ambient or large samples or for the analysis of in vivo tissue since such target samples cannot be provided in a sub-atmospheric pressure environment. Furthermore, the proximity of the secondary laser beam to the surface of the target sample presents user safety issues and renders the disclosed arrangement unsuitable for the analysis of in vivo tissue.

A yet further problem with the known arrangement is that the sample must still be embedded in a MALDI matrix in a conventional manner with the result that natural or unmodified target samples cannot be analysed using the known arrangement.

It is therefore desired to provide an improved ion source.

SUMMARY

According to an aspect there is provided an ambient or atmospheric pressure ion source comprising:

a first laser source arranged and adapted to generate ions and/or neutral particles from a target;

a transfer device arranged and adapted to cause the ions and/or the neutral particles to pass along a first path or axis within the transfer device; and a secondary activation source or device which is arranged and adapted to direct laser radiation or photons along, across or over at least a portion of the first path or axis so as to cause secondary activation of the ions and/or the neutral particles.

The secondary activation device may comprise an ionisation device, a secondary ionisation device, a further ionisation device, a photo-ionisation device or a post-ionisation device for ionising neutral particles. The secondary activation device may comprise, for example, a UV laser, a VUV lamp or a UV LED.

The ion source may comprise an ambient or atmospheric pressure ion source where the target is maintained at ambient or atmospheric pressure. It will be understood that ambient or atmospheric pressure will vary as a function of height above sea level but nonetheless a person skilled in the art will appreciate that ambient or atmospheric pressure at sea level is approx. 1013 mbar. It will also be understood that typical ambient or atmospheric pressures at sea level may vary due to weather conditions and hence ambient or atmospheric pressure should at least include the range 980-1030 mbar.

Accordingly, the phrase "ambient or atmospheric pressure ion source" should be construed at least as including ion sources wherein the target sample is maintained at a pressure within the range of 980-1030 mbar. It is also contemplated that the ambient or atmospheric pressure ion source according to various embodiments may at times operate at a pressure below 980 mbar and/or at a pressure greater than 1030 mbar.

The atmospheric pressure range of operation of the ion source according to various embodiments may be contrasted with the known arrangement which requires the target to be provided in a sub-atmospheric pressure vacuum chamber which is maintained at a pressure of around 2.0-2.5 mbar (i.e. at a pressure of approximately 0.2% of atmospheric pressure).

Accordingly, the ion source according to various embodiments does not suffer from the problem of requiring a target sample to be manipulated into the vacuum chamber of a mass spectrometer which may either be undesirable or impossible for some desired targets. In particular, the ion source according to various embodiments is able to ionise samples which are maintained at ambient or atmospheric pressure and also the ion source does not require a matrix to be added to the sample prior to ionisation. The various embodiments therefore enable a wide variety of targets to be easily ionised and analysed and enable an ambient or atmospheric pressure ion source potentially to be used to analyse in vivo tissue samples or natural samples.

The first laser source may comprise an ultraviolet ("UV") laser having a wavelength in the range 100-380 nm. For example, according to an embodiment the first laser source may comprise a nitrogen laser (having a wavelength of e.g. 337 nm) or a frequency tripled or frequency quadrupled Nd:YAG laser (having a wavelength of 355 nm or 266 nm respectively).

However, it is not essential that the first laser source emits ultraviolet radiation and other embodiments are contemplated wherein the first laser source may emit visible radiation having a wavelength in the range 400-800 nm. Other embodiments are contemplated wherein the first laser source may comprise an infra-red ("IR") laser source emitting photons having wavelengths in the infra-red (i.e. 750 nm-1 mm), near infra-red (0.75-1.4 μm) or short-wavelength infra-red (1.4-3 μm). For example, according to an embodiment IR MALDI may be performed wherein the matrix comprises water or another non-toxic or inert matrix. The non-toxic or inert matrix (e.g. water or another substance) may exist naturally within the sample or may be added in situ.

The transfer device may be arranged upstream of an atmospheric pressure interface of an analytical device such as a mass spectrometer. The interface of the analytical device may comprise an interface between an atmospheric pressure or ambient pressure region (external to the analytical device) and a sub-atmospheric pressure region (within the analytical device). Analyte ions may be arranged to pass through the interface into a first or initial vacuum chamber of the analytical device.

The interface of the analytical device or mass spectrometer may comprise an atmospheric pressure interface which may constitute the primary inlet into the analytical device or mass spectrometer. According to various embodiments the pressure upstream of the atmospheric pressure interface may be at atmospheric or ambient pressure and the pressure downstream of the atmospheric pressure interface may be at a lower pressure than atmospheric or ambient pressure. For example, according to an embodiment one side of the atmospheric pressure interface may be maintained at a pressure of 1000 mbar whilst the other side of the atmospheric pressure interface may be maintained at a pressure <100 mbar.

The analytical device may comprise, for example, an ion mobility spectrometer or separator, a differential ion mobility spectrometer or separator or a mass spectrometer or mass analyser.

The secondary activation source or device may be arranged and adapted to generate a second laser beam, laser radiation or photons along a substantial portion of the first path or axis along which ions and/or neutral particles pass along and through the transfer device.

The transfer device may comprise a housing through which ions and/or neutral particles pass. The housing may comprise one or more optically transparent sections enabling ions and/or neutral particles within the housing to be subjected to secondary activation by photons passing through the one or more optically transparent sections of the housing of the transfer device.

The orientation of the second laser beam or the extent to which photons from the secondary activation device impinge upon ions and/or neutral particles passing through the transfer device may be arranged so as to optimise or increase the interaction between ions and/or neutral particles and photons from the secondary activation device. The interaction between the ions and/or neutral particles with photons from the secondary activation device causes the ions and/or neutral particles within the transfer device to be subjected to secondary activation (e.g. ionisation, fragmentation or declustering).

The secondary activation source or device or second laser device may be arranged and adapted to emit a laser beam or one or more pulses which are directed and/or focused so as to be at an angle of substantially 0° or 180° to the general direction of travel of the ions and/or neutral particles along, within and through the transfer device. The secondary activation source or second laser device may, therefore, emit a laser beam or pulse which is directed and/or focused so as to be substantially in-line with or co-axial to the general direction of travel of the ions and/or neutral particles along, within and through the transfer device.

However, is not essential that the secondary activation device either emits one or more pulses of laser radiation or that one or more pulses of laser radiation are emitted from the secondary activation device in a direction which is substantially in-line with the direction of travel of ions and/or neutral particles along, within and through the transfer device. For example, other embodiments are contemplated wherein the secondary activation device may comprise a non-laser source such as a vacuum ultraviolet ("VUV") lamp which may be arranged to emit ultraviolet light in the vacuum ultraviolet band (100-200 nm). Other embodiments are contemplated wherein the secondary activation device may comprise one or more light emitting diodes ("LEDs") having a wavelength of approx. 250 nm.

The secondary activation source may emit a pulsed or continuous beam of light, electromagnetic radiation or laser radiation. For example, the secondary activation device may comprise a continuous or pulsed laser source or a continuous or pulsed non-laser source (such as a LED source).

The known arrangement uses a pulsed UV laser beam as a secondary ionisation source to intercept an expanding particle plume in the vacuum chamber. The pulsed UV laser beam is incident in a substantially orthogonal direction to that of the central or longitudinal axis of the expanding particle plume. The pulsed secondary UV laser beam is therefore incident in a direction which is generally orthogonal to the central direction of travel of the expanding MALDI plume. As a result, there is only a small degree of overlap between the secondary UV laser beam and the MALDI plume.

In contrast, according to various embodiments, as a result of the orientation of the laser radiation or photons emitted from the secondary activation device there is arranged to be a significant degree of both spatial and temporal overlap between the laser radiation or photons emitted from the secondary activation or ionisation device and the ions and/or neutral particles as they travel or pass within and through the transfer device.

According to an embodiment the transfer device may comprise one or more capillaries, one or more heated capillaries, one or more tubular or hollow guides or one or more tubular or hollow optical fibres. The transfer device may comprise an annular or tubular housing through which particles from a MALDI plume are directed.

The ion source according to various embodiments comprises a transfer device for transmitting a mixture of ions and neutral particles generated by the first laser source along a first path or axis within a housing of the transfer device towards an atmospheric pressure interface of an analytical device. The transfer device may be provided intermediate between a target sample and the inlet or atmospheric pressure interface of the analytical device and the transfer device may comprise a capillary, a heated capillary, a tubular arrangement or a hollow optical fibre. The capillary, heated capillary, tubular arrangement or hollow optical fibre may have a curved inlet and/or a curved outlet section and may have a substantially linear central section. By way of contrast, the known arrangement does not comprise a transfer device or a transfer device having a housing which is arranged to transmit or otherwise guide ions and/or neutral particles towards an interface of an analytical device and wherein ions and/or neutral particles may be subjected to secondary activation within the transfer device or the housing of the transfer device.

The transfer device may be arranged so that ions and/or neutral particles which are desired to be subjected to secondary activation pass along a first path or axis which may be >1 cm, 1-2 cm, 2-3 cm, 3-4 cm, 4-5 cm, 5-6 cm, 6-7 cm, 7-8 cm, 8-9 cm, 9-10 cm or >10 cm long within the housing of the transfer device. The ions and/or neutral particles may be exposed to laser radiation or photons from the secondary activation device over the course of passing along the first path or axis through the housing of the transfer device.

It will be appreciated that the path length of several centimetres over or along which ions and/or neutral particles may be exposed to laser radiation or photons from the secondary activation device according to various embodiments is substantially greater than the overlap between the secondary laser beam and the MALDI plume in the known arrangement (wherein the overlap is only a few millimetres).

It is apparent, therefore, that the transfer device according to various embodiments enables at least an order of magnitude greater path length along which ions and/or neutral particles may overlap and interact with laser radiation or photons from the secondary activation device to be achieved relative to the known arrangement.

As a result, the various embodiments enable a significant enhancement in secondary activation to be achieved relative to the known arrangement.

Although in the simplest form the transfer device may comprise a capillary interface which directs ions towards at atmospheric pressure interface of a mass spectrometer, other embodiments are contemplated wherein the transfer device may be selected from the group consisting of: (i) a drift tube; (ii) an ion mobility separator or spectrometer; (iii) a differential ion mobility separator or spectrometer or a Field Asymmetric Ion Mobility Spectrometry ("FAIMS") device; or (iv) a device for temporally separating ions and/or neutral particles according to a physico-chemical property.

According to these embodiments ions passing through the transfer device and/or ions generated within the transfer device due to interaction with photons emitted from the secondary activation device may be arranged to separate temporally according to their mass, mass to charge ratio, ion mobility, differential ion mobility, collision cross-section or other physico-chemical property.

The temporal separation of ions according to their mass, mass to charge ratio, ion mobility, differential ion mobility, cross-section or other physico-chemical property may be utilised in order to separate, isolate, react, detect, filter, select or identify the ions passing through the transfer device and/or ions or other particles generated, created or formed within the transfer device due to secondary activation.

According to an embodiment the transfer device and in particular the first path or axis within a housing of the transfer device may be distal from the target or the surface of the target. According to an embodiment the first path or axis through the housing of the transfer device may be separated from the target or a surface of the target by at least 20 mm, 25 mm, 30 mm, 35 mm, 40 mm, 45 mm or 50 mm.

The transfer device may comprise a housing having a first inlet through which ions and/or neutral particles may enter the transfer device and/or a second outlet through which ions and/or further ions and/or neutral particles may exit the transfer device.

The transfer device may comprise a linear capillary section optionally having a curved or linear inlet section and/or a curved or linear outlet section. Ions and/or neutral particles may be caused to enter and/or exit the transfer device by gas flow effects. One or more electric fields or transient DC voltages may be applied across or to portions of the transfer device in order to urge ions along and through regions of the transfer device and optionally to control or alter the speed or velocity at which ions or other charged particles are passed or otherwise transmitted through regions of the transfer device.

The transfer device may comprise one or more inlets for introducing one or more reagents into the transfer device so that ions and/or neutral particles may be subjected to one or more reactions within the transfer device due to the presence of the one or more reagents which are introduced into the housing of the transfer device.

Various embodiments are contemplated wherein reactions may be performed within the transfer device such that the transfer device acts as a transfer reaction device.

For example, according to an embodiment gas-phase hydrogen/deuterium exchange ("HDX") reactions may be performed within the transfer reaction device. According to such an embodiment gaseous $ND_3$ may be introduced into the transfer reaction device such that analyte ions or other particles may undergo hydrogen/deuterium exchange as they mix with the $ND_3$ and pass towards the exit of the transfer reaction device and onwards towards the inlet of the mass spectrometer. The extent of deuterium labelling may be controlled by varying the quantity of $ND_3$ and/or the speed at which the analyte ions or other particles pass through the transfer reaction device. The speed at which the analyte ions or other particles pass through the transfer reaction device may be controlled by gas flow effects and/or by application of one or more electric fields. It will be understood that hydrogen/deuterium exchange of protein ions is highly sensitive to protein conformation and hence enables the detection of conformers.

According to an embodiment hydrogen/deuterium exchange reagents (gas or liquid) may be introduced into the transfer reaction device via a first supplementary inlet and/or via a second supplementary inlet. If a hydrogen/deuterium exchange reaction is performed within the transfer reaction device then the second laser source may optionally either not be provided or may not be activated.

Analyte ions and/or neutral particles and/or matrix or other ions within the inlet transfer device or inlet transfer reaction device may also be subjected to other various reactions. For example, analyte ions and/or neutral particles may be subjected to fast photochemical oxidation of proteins ("FPOP") type reactions. Fast photochemical oxidation of proteins ("FPOP") is a chemical footprinting method whereby exposed amino-acid residues are covalently labelled by oxidation with hydroxyl radicals produced by the photolysis (i.e. photodissociation or photodecomposition) of hydrogen peroxide. Although oxidation via hydroxyl radicals induces unfolding in proteins on a time scale of milliseconds or longer, FPOP is designed to limit *OH exposure to 1 μs or less by employing a pulsed laser for initiation to produce radicals and a radical-scavenger to limit their lifetimes.

One or more reagents which may be added to the transfer device may alternatively be added to promote Electron Capture Dissociation ("ECD") and/or Electron Transfer Dissociation ("ETD") of ions within the transfer device. The fragment ions resulting from fragmentation or declustering processes such as Electron Capture Dissociation ("ECD") and/or Electron Transfer Dissociation ("ETD") may be mass analysed so as to provide useful information which is helpful to confirm the precise identity of the analyte ions.

One or more detectors may be provided for detecting or determining the effect of secondary activation on ions or other particles before and/or during and/or after ions and/or neutral particles have been subjected to secondary activation within the transfer device.

The detector may comprise a spectroscopy detector which may be arranged to detect light emitted from the second laser or other light source and to detect the effect of secondary activation of ions and/or neutral particles within the inlet transfer device or inlet transfer reaction device. For example, the detector may be used to determine absorption spectra due to the presence of ions or other particles within the inlet transfer device or inlet transfer reaction device before and/or during and/or subsequent to secondary activation or photoactivation by the secondary laser source or other light source.

The detector may also be used to monitor the laser or non-laser energy and to assist in initial alignment of e.g. the inlet transfer device relative to the secondary activation device.

The secondary activation source may comprise a laser source and various parameters of the secondary laser source may be set in order to optimise the promotion of secondary activation of ions and/or neutral particles within the transfer device. For example, the frequency or wavelength of the secondary laser source may be set, tuned or varied and the intensity of the laser beam or pulse(s) emitted from the secondary laser source may be set, tuned or varied in order to promote optimal (or desired) secondary activation of ions and/or neutral particles within the transfer device or the housing of the transfer device. The secondary laser source may emit pulses of photons and the duration of the laser pulses and the interval between laser pulses may be optimised or varied as desired. Accordingly, the mark/space ratio of laser pulses emitted from or by the secondary laser may be optimised or varied in order to promote optimal secondary activation or to vary, alter or control the degree of secondary activation.

For example, different modes of operation are contemplated wherein in a first mode ions and/or neutral particles may be subjected to a first (e.g. high) level of secondary activation and a second mode wherein ions and/or neutral particles may be subjected to a second (e.g. lower) level of secondary activation. A control system may be arranged to switch repeatedly back and forth between the first and second modes e.g. one or more times every 0.1, 0.2, 0.3, 0.4, 0.5, 0.6, 0.7, 0.8, 0.9, 1, 2, 3, 4, 5, 6, 7, 8, 9, 10 or >10 s.

In another mode of operation ions and/or neutral particles may be directed through the transfer device in a first mode in order to subject the ions and/or neutral particles to secondary activation and then in a second mode the ions and/or neutral particles may be arranged to by-pass the transfer device. A control system may be arranged to switch repeatedly back and forth between the first and second modes e.g. one or more times every 0.1, 0.2, 0.3, 0.4, 0.5, 0.6, 0.7, 0.8, 0.9, 1, 2, 3, 4, 5, 6, 7, 8, 9, 10 or >10 s.

The secondary activation source may comprise a non-laser source of photons or one or more vacuum ultraviolet ("VUV") lamps, one or more light emitting diodes ("LEDs"), one or more visible photon sources or one or more infra-red ("IR") photon sources. Embodiments are contemplated, for example, wherein the secondary activation source may comprise a source of visible radiation (400-800 nm) or a source of infra-red ("IR") radiation (800 nm-1 mm). The visible or infra-red source of electromagnetic radiation or photons may comprise a laser or a non-laser source.

It is not essential that the secondary activation device comprises a laser source and embodiments are contemplated wherein a non-laser source of photons may be provided. For example, one or more vacuum ultraviolet ("VUV") lamps may be provided adjacent to the transfer device in order to promote or cause secondary activation of ions and/or neutral particles within the transfer device. One or more portions of the housing of the transfer device may be made transparent or at least semi-transparent to ultraviolet radiation (and/or other wavelengths of light) in order to allow the ultraviolet or other photons to pass through the housing of the transfer device so as to cause ions and/or neutral particles within the housing of the transfer device to be subjected to secondary activation.

The secondary activation may comprise a process involving ionisation, secondary ionisation, further ionisation, photo-ionisation or post-ionisation of ions and/or the neutral particles. The secondary activation device may comprise an ionisation device, a secondary ionisation device, a further ionisation device, a photo-ionisation device or a post-ionisation device for ionising the ions and/or the neutral particles.

The secondary activation may comprise a process involving photo-fragmentation, photo-activation, photo-dissociation, fragmentation, activation, dissociation, Electron Capture Dissociation ("ECD"), Electron Transfer Dissociation ("ETD"), declustering, reacting, fast photochemical oxidation of proteins ("FPOP") reactions or hydrogen/deuterium exchange ("HDX") reactions of ions and/or neutral particles.

The secondary activation device may comprise a photo-fragmentation device, a photo-activation device, a photo-dissociation device, a fragmentation device, an activation device, a dissociation device, an Electron Capture Dissociation ("ECD") device, an Electron Transfer Dissociation ("ETD") device, a declustering device, a reaction device, a fast photochemical oxidation of proteins ("FPOP") reaction device or a hydrogen/deuterium exchange ("HDX") reaction device.

According to an aspect there is provided an analytical device comprising an ambient or atmospheric pressure ion source as described above.

The analytical device may comprise an ion mobility spectrometer or separator, a differential ion mobility spectrometer or separator or a mass spectrometer.

The analytical device may further comprise an atmospheric pressure interface wherein the transfer device is arranged and adapted to direct ions/or neutral particles towards the atmospheric pressure interface.

According to another aspect there is provided a method of generating ions at ambient or atmospheric pressure comprising:

directing emission from a first laser source at a target in order to generate ions and/or neutral particles;

transmitting the ions and/or neutral particles along a first path or axis within a transfer device; and directing laser radiation or photons along, across or over at least a portion of the first path or axis so as to cause secondary activation of the ions and/or the neutral particles.

According to another aspect there is provided a method of analysis comprising a method of generating ions as described above.

According to another aspect there is provided an ambient or atmospheric pressure ion source comprising:

a first laser source or other photoionisation device arranged and adapted to generate ions and/or neutral particles from a target optionally by ablation and/or desorption;

a transfer reaction device arranged and adapted to transmit the ions and/or the neutral particles along a first path or axis optionally towards an interface with an analytical device; and a device which is arranged and adapted to introduce one or more reagents into the transfer device so that the one or more reagents react with or interact with the ions and/or the neutral particles.

According to another aspect there is provided a method of generating ions at ambient or atmospheric pressure comprising:

directing emission from a first laser source or other photoionisation device at a target in order to generate ions and/or neutral particles optionally by ablation and/or desorption;

transmitting the ions and/or neutral particles along a first path or axis through a transfer reaction device optionally towards an interface with an analytical device; and introducing one or more reagents into the transfer reaction device so that the one or more reagents react with or interact with the ions and/or the neutral particles.

It will be understood that according to other embodiments the provision of a secondary activation device is not essential. For example, as described above, embodiments are contemplated wherein a device may be provided which is arranged and adapted to introduce one or more reagents into the transfer device so that the one or more reagents may react with or interact with ions and/or neutral particles (generated by a photo-ionisation device such as a MALDI device) within the transfer device.

Various embodiments are disclosed which relate to dual laser technology wherein samples may be analysed at atmospheric or ambient pressure or conditions. Operating at atmospheric or ambient pressures (rather than at a low vacuum) has several advantages compared with the known arrangement which requires the target sample to be provided in a vacuum chamber.

Furthermore, ambient desorption along with secondary ionisation according to various embodiments provides the possibility of more facile in vitro and even in vivo imaging (e.g. using IR lasers without matrix) and is a potential application of such technology.

Another benefit of the dual laser approach which is disclosed according to various embodiments is that the primary laser is freed from the requirement to provide traditional MALDI ionisation. In particular, the wavelength, fluence and spot size of the primary laser beam or pulse can be tailored to the analysis in terms of tissue desorption and user safety. Accordingly, the primary laser can be used to generate analyte from an in vivo sample which is not possible using the known arrangement.

A yet further beneficial effect of the various disclosed embodiments is that the secondary laser or secondary activation device (which may comprise an ultra-violet or UV laser) is that it is possible to effectively decouple the process of ablating and desorbing analyte material from the surface of the target sample from the process of optimising the subsequent ionisation of analyte material.

In particular, according to the various embodiments the process of optimising the subsequent ionisation of analyte material can be performed at a relatively remote and safer location away from the tissue of interest which may comprise a living organism.

A particularly significant beneficial aspect of the various disclosed embodiments is the ability to ensure that there is a significant degree of overlap between the desorbed plume released from the target and the secondary activation or ionisation laser beam. This is not the case with the known arrangement.

Accordingly, various embodiments are disclosed wherein in general terms a laser desorption source may be provided which may operate at atmospheric or ambient pressures and which is capable of generating particles or analyte from one or more specific points on the surface of a target sample. The laser desorption source may include a secondary ionisation device e.g. a second laser device. The second or secondary laser device may be arranged to generate a laser beam or pulse which is directed along a path which has a significant degree of overlap with the particles ablated from the surface of the target sample and which form a resulting MALDI plume. The desorbed plume may be pumped through a capillary or other transfer device towards a mass spectrometer, ion mobility analyser or other analytical device. The secondary laser may be arranged to generate a laser beam or pulse(s) which have a significant degree of overlap with the desorbed plume which is entrained within the capillary or other transfer device.

It will be apparent, therefore, that the various embodiments represent a significant improvement in the art since the various embodiments relate to an ambient or atmospheric pressure ion source which enables a significantly enhanced ion yield to be achieved and which is potentially suitable for analysing in vivo tissue. Furthermore, the ion source according to various embodiments is safer than the known arrangement since the secondary laser beam or laser pulse(s) interacts with ions, neutral particles or analyte at a location which is substantially separated from or otherwise removed from that of the surface of the target sample. Furthermore, the first (primary) laser beam or pulse may be optimised for enhanced ablation and desorption whilst the second (secondary) laser beam or pulse may be optimised for secondary activation (e.g. ionisation, fragmentation or declustering).

According to an aspect there is provided an atmospheric pressure surface desorption source whereby: (i) desorbed sample particles are subsequently activated to generate ions and product ions using a secondary activation laser (or alternatives) with or without the addition of an ionizing matrix; and (ii) the secondary activation laser is arranged geometrically to be substantially in-line with the particles to enable optimum particle to laser exposure time.

The ion source may according to various embodiments comprise an Atmospheric Pressure Photo Ionisation ("APPI") ion source, a Matrix Assisted Laser Desorption Ionisation ("MALDI") ion source, a Laser Desorption Ionisation ("LDI") ion source, an Atmospheric Pressure Ionisation ("API") ion source, an Atmospheric Pressure Matrix Assisted Laser Desorption Ionisation ion source, a Laser Ablation Electrospray Ionisation ("LAESI") ion source or a Surface Assisted Laser Desorption Ionisation ("SALDI").

The spectrometer may comprise one or more continuous or pulsed ion sources.

The spectrometer may comprise one or more ion guides.

The spectrometer may comprise one or more ion mobility separation devices and/or one or more Field Asymmetric Ion Mobility Spectrometer devices.

The spectrometer may comprise one or more ion traps or one or more ion trapping regions.

The spectrometer may comprise one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infra-red radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The ion-molecule reaction device may be configured to perform ozonlysis for the location of olefinic (double) bonds in lipids.

The spectrometer may comprise a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

The spectrometer may comprise one or more energy analysers or electrostatic energy analysers.

The spectrometer may comprise one or more ion detectors.

The spectrometer may comprise one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wen filter.

The spectrometer may comprise a device or ion gate for pulsing ions; and/or a device for converting a substantially continuous ion beam into a pulsed ion beam.

The spectrometer may comprise a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser.

The spectrometer may comprise a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer may comprise a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) > about 500 V peak to peak.

The AC or RF voltage may have a frequency selected from the group consisting of: (i) < about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) > about 10.0 MHz.

The ion guide may be maintained at a pressure selected from the group consisting of: (i) < about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) > about 1000 mbar.

Analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

Optionally, in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

Optionally, in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenyl-anthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

The process of Electron Transfer Dissociation fragmentation may comprise interacting analyte ions with reagent ions, wherein the reagent ions comprise dicyanobenzene, 4-nitrotoluene or azulene.

The spectrometer may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation a Quantification mode of operation or an Ion Mobility Spectrometry ("IMS") mode of operation.

BRIEF DESCRIPTION OF THE DRAWINGS

Various embodiments will now be described, by way of example only, and with reference to the accompanying drawing in which:

FIG. 1 shows an embodiment wherein a laser is directed on to a target sample so as to generate a plume of ions and neutral particles and wherein the plume of ions and neutral particles is then directed into a capillary inlet transfer device wherein a second laser beam is focused along the axis of the capillary inlet transfer device in order to ionise neutral particles within the capillary inlet transfer device.

DETAILED DESCRIPTION

FIG. 1 illustrates an embodiment wherein a first or primary laser source 1 is provided upstream of a target sample. The first laser source 1 is arranged and adapted to emit a first laser beam 4 or pulse(s) of laser radiation (or to otherwise emit photons) which may then be focused by a first focusing lens 5 on to the target sample. The first laser source may comprise, for example, an ultra-violet ("UV") laser such as a nitrogen laser e.g. having a wavelength of e.g. 337 nm.

According to other embodiments the primary laser may comprise a frequency tripled (or frequency quadrupled) Nd:YAG laser having a wavelength of 355 nm (or 266 nm).

The first laser or laser system 1 may comprise a tuneable wavelength laser. For example, the first laser or laser system 1 may utilise one or more optical parametric oscillators ("OPO") thereby enabling the wavelength of the laser light output from the first laser or laser system 1 to be varied or otherwise altered.

Further embodiments are contemplated wherein laser light from the first laser source 1 may be directed on to the target sample using a fibre optic laser delivery system. The fibre optic laser delivery system may comprise one or more optical fibres.

Other embodiments are contemplated wherein different primary laser sources 1 may be utilised.

The target sample may comprise a sample or portion of tissue 2 which may be provided on a substrate 3 such as a metallic plate. The target sample may be embedded into a crystalline MALDI matrix in a conventional manner. However, according to other alternative embodiments is not necessary for the target to be embedded in a MALDI matrix and it is contemplated, for example, that the target sample may comprise a natural or unmodified sample which is not embedded in a MALDI matrix. According to an embodiment no chemicals, reagents or other substances may have been added to the natural or unmodified sample which is to be ionised by the first laser source 1. It will be understood that the ability to be able to analyse a natural target sample without needing to add a chemical, reagent or matrix to the sample (for reasons of wanting to improve the ionisation efficiency) is particularly beneficial.

It is also not essential that the target is provided on a substrate 3 or metallic plate. For example, embodiments are contemplated wherein the primary laser 1 and the beam or pulse 4 of radiation emitted from the primary laser 1 may be directed on to a target which may comprise ex vivo or in vivo tissue and wherein the tissue is not provided on a substrate 3.

Yet further embodiments are contemplated wherein the sample may involve liquid atmospheric pressure Matrix Assisted Laser Desorption Ionisation ("AP-MALDI") or liquid extraction surface analysis ("LESA").

Liquid UV-MALDI matrices are known and provide an alternative to embedding samples to be ionised by MALDI in a crystalline matrix. The liquid matrix may comprise an ionic liquid matrix ("ILM") which may comprise a viscous liquid matrix which may be doped with UV light absorbing chromophores. Known ionic liquid matrices which may be used in liquid MALDI techniques include equimolar mixtures of conventional MALDI matrix compounds such as 2,5-dihydroxybenzoic acid ("DHB"), α-cyano-4-hydroxycinnamic acid ("CCA") or sinapinic acid ("SA") together with an organic base such as pyridine ("Py"), tributylamine ("TBA") or N,N-dimethylethylenediamine ("DMED").

Liquid extraction surface analysis mass spectrometry ("LESA-MS") is a surface profiling technique that combines micro-liquid extraction from a solid surface with nanoelectrospray mass spectrometry. One potential application is the examination of the distribution of drugs and their metabolites by analysing ex vivo tissue sections. According to an embodiment an extraction solvent may be pipetted into a robotic tip and the solvent may then be dispensed from the robotic tip onto the surface of the target sample. The target sample may comprise ex vivo tissue. Analytes are then extracted from the target sample into the solvent and the solution extract is then withdrawn or aspirated into the robotic tip. The robotic tip may then be translated so as to engage with the rear surface of, for example, an Electrospray Ionisation ("ESI") chip. A high voltage may be applied to the pipette tip and nanoelectrospray ionisation may then be initiated. A mixture of analyte ions and neutral particles may then be released.

Accordingly, embodiments are contemplated wherein the first or primary laser source 1 may be substituted with an Electrospray or nanoelectrospray ionisation device and in particular a miniature electrospray device or chip.

Embodiments are also contemplated wherein Atmospheric Pressure Matrix Assisted Laser Desorption Ionisation ("AP-MALDI") may be performed from a LESA droplet.

One or more contrast reagents may be added to the sample. The one or more contrast agents may be added to the sample in order to improve optical visualisation or analysis of the sample. The one or more contrast reagents may also be added to the sample in order to improve analysis and/or imaging of the sample by e.g. Magnetic Resonance Imaging ("MRI"), MALDI mass spectrometry imaging or other imaging techniques.

The one or more contrast reagents enable combined imaging techniques to be performed. The semi-quantitative nature of the image obtained according to various embodiments can be combined with e.g. a MRI image in order to improve the overall analysis quality. It will be understood that MRI quantitation can be limited.

A second or secondary laser source 6 may be provided which may be arranged to emit a second laser beam or single or multiple pulses 7 of laser radiation (or to otherwise emit photons) which may then be focused by a second focusing lens 8 on to and through a first window or port 9 of an inlet transfer device or inlet transfer reaction device 10. The first window or port 9 of the inlet transfer device or inlet transfer reaction device 10 may be proximal to the second laser source 6 or other secondary activation device. The inlet transfer device or inlet transfer reaction device 10 may comprise a second window or port 11 at the other end of the inlet transfer device or inlet transfer reaction device 10 to that of the first window or port 9.

A detector 18 may be provided adjacent to or in close proximity with the second window or port 11. The detector 18 may comprise a spectroscopy detector which may be arranged to detect light emitted from the second laser 6 and to detect the effect, effectiveness or progress of secondary activation of ions and/or neutral particles within the inlet transfer device or inlet transfer reaction device 10. For example, the detector 18 may be used to determine the absorption spectra of material, particles or ions within the inlet transfer device or inlet transfer reaction device 10 before and/or during and/or subsequent to secondary activation or photoactivation by the secondary laser source 6 or other secondary activation device.

The second laser or laser system 6 may comprise a tuneable wavelength laser. For example, the second laser or laser system 6 may utilise one or more optical parametric oscillators ("OPO") thereby enabling the wavelength of the laser light output from the second laser or laser system 6 to be varied or otherwise altered.

Further embodiments are contemplated wherein laser light from the second laser source 6 (or photons from another secondary activation device) may be directed on to and along the axis of the inlet transfer device or inlet transfer reaction device 10 using a fibre optic laser delivery system. The fibre optic laser delivery system may comprise one or more optical fibres.

Other embodiments are contemplated wherein different secondary laser sources 6 may be utilised. Yet further embodiments which are discussed in more detail below are contemplated wherein the secondary laser source 6 may be replaced within a different type of secondary activation device. For example, it is not essential that the secondary activation device comprises a laser and accordingly it should be appreciated that other non-laser photo-activation devices may be utilised.

As will be described in more detail below, the second laser source 6 is arranged to act as a secondary activation device with the purpose of subjecting ions and/or neutral particles within the inlet transfer device or inlet transfer reaction device 10 to secondary activation. The process of secondary activation may include one or more processes such as ionisation, secondary ionisation, further ionisation, photo-ionisation or post-ionisation of ions and/or neutral particles within the inlet transfer device or inlet transfer reaction device 10. The process of secondary activation may comprise photo-fragmentation, photo-activation, photo-dissociation, fragmentation, activation, dissociation, Electron Capture Dissociation ("ECD"), Electron Transfer Dissociation ("ETD"), declustering, reacting, fast photochemical oxidation of proteins ("FPOP") reactions or hydrogen/deuterium exchange ("HDX") reactions of ions and/or neutral particles.

The inlet transfer device or inlet transfer reaction device 10 may comprise a main inlet or port 12 and optionally a first supplementary inlet or port 13 and/or optionally a second supplementary inlet or port 15. One or more reagents, chemicals, liquids or gases may be introduced into the inlet transfer device or inlet transfer reaction device 10 via the first supplementary inlet or port 13 and/or via the second supplementary inlet or port 15.

Other embodiments are contemplated wherein the inlet transfer device or inlet transfer reaction device 10 may comprise further inlets or ports. It is also contemplated that the direction of flow of e.g. a reagent or other gas or liquid through the first supplementary inlet or port 13 may be changed or reversed so that the first supplementary inlet or port 13 may in fact operate as an outlet. Similarly, the direction of flow of e.g. a reagent or other gas or liquid through the second supplementary inlet or port 15 may be changed or reversed so that the second supplementary inlet or port 15 may in fact operate as an outlet.

According to an embodiment the inlet transfer device or inlet transfer reaction device 10 may comprise a Field Asymmetric Ion Mobility Spectrometry ("FAIMS") device, an atmospheric pressure drift tube, a drift region, a separation region, an ion mobility spectrometer or separator ("IMS") or another device for separating particles and/or ions according to a physico-chemical property such as mass, mass to charge ratio, ion mobility, differential ion mobility or collision cross section.

A further embodiment is contemplated wherein at least a portion or substantially the whole of the outer housing of the inlet transfer device or inlet transfer reaction device 10 may be (optically) transparent to allow ions and/or particles within the inlet transfer device or inlet transfer reaction device 10 to be subjected to direct illumination via, for example, one or more vacuum ultra-violet ("VUV") lamps or a source of visible or infra-red radiation. The one or more vacuum ultra-violet ("VUV") lamps (or other sources of photons) may be provided so as to surround a central region of the inlet transfer device or inlet transfer reaction device 10. As a result, ions and/or neutral particles within the inlet transfer device or inlet transfer reaction device 10 may be subjected to secondary activation by radiation from one or more vacuum ultra-violet ("VUV") lamps or other sources of ultra-violet photons or one or more sources of visible or infra-red photons.

It will be apparent, therefore, that it is not essential that the secondary activation device comprises a second laser source. For example, it should be understood that non-laser sources of photons may be utilised in order to illuminate ions and/or neutral particles within the inlet transfer device or inlet transfer reaction device 10 and hence to subject ions and/or neutral particles within the inlet transfer device or inlet transfer reaction device 10 to secondary activation. Accordingly, the secondary activation device may comprise a non-laser source of photons for photo-activating ions and/or neutral particles within the inlet transfer device or inlet transfer reaction device 10. The non-laser source of photons may comprise a VUV lamp or a UV LED.

According to an embodiment the first laser source 1 may be activated, energised or otherwise turned ON and one or more first laser beam(s), pulse(s) of electromagnetic radiation or pulse(s) of photons 4 may be focussed down on to the sample target. The impact of the photons upon the target sample surface may result in a plume of target material being generated or otherwise being ablated or desorbed from the surface of the sample target.

The plume of target material may comprise analyte ions, neutral analyte molecules and matrix ions and/or matrix molecules (if a matrix is optionally added to the target sample). It will be understood, however, that it is not essential for a matrix or other reagent to be added to the target sample and indeed a particularly beneficial effect of the various disclosed embodiments is that the target sample may be ionised and analysed in a substantially unmodified or natural state i.e. wherein no matrix or other reagent is added to the target sample prior to initial ionisation, ablation or desorption by the first or primary laser source 1. This is particularly beneficial in terms of simplicity, efficiency and avoiding toxicity issues in relation to the sample which may, for example, comprise in vivo tissue.

The plume of analyte or target material, optionally including matrix ions and/or matrix molecules may be arranged to enter the inlet transfer device or inlet transfer reaction device 10 via the first main inlet or port 12. The first main inlet or port 12 may comprise a capillary or heated capillary or a portion of a capillary or heated capillary. The capillary or heated capillary or the portion of the capillary or heated capillary may have a curved or non-linear portion.

As shown in FIG. 1, the inlet transfer device or inlet transfer reaction device 10 may comprise a central portion or region which may comprise a capillary, capillary tube, tube or other hollow transfer member. Analyte material and analyte ions may be arranged to flow into the housing of the inlet transfer device or inlet transfer reaction device 10 via the main inlet or port 12 so that the analyte material, analyte ions and optionally matrix ions and/or neutral matrix molecules flow along and through the central portion, housing or region of the inlet transfer device or inlet transfer reaction device 10. Any analyte material, analyte ions, matrix ions or neutral matrix molecules together with any new particles or ions which may be generated within the inlet transfer device or inlet transfer reaction device 10 by the process of secondary activation may then be directed so as to exit the inlet transfer device or inlet transfer reaction device 10 via the main outlet or port 14. The first main outlet or port 14 may comprise a capillary or heated capillary or a portion of a capillary or heated capillary. The capillary or heated capillary or the portion of the capillary or heated capillary may have a curved or non-linear portion.

The main outlet or port 14 may be connected to or may otherwise be provided in close proximity to a restriction orifice or atmospheric pressure interface 19 of an analytical device. The restriction orifice or atmospheric pressure interface 19 may, therefore, provide an interface between an ambient, atmospheric or above atmospheric pressure region and a lower pressure or sub-atmospheric pressure region. The restriction orifice or atmospheric pressure interface 19 may lead directly into an initial or first vacuum chamber or housing 16 of a mass spectrometer 17, ion mobility spectrometer, differential ion mobility spectrometer or other analytical device or analytical analyser.

The speed at which target material, analyte or other material from the plume passes through the central portion of the inlet transfer device or inlet transfer reaction device 10 may be calculated or otherwise determined based upon inter alia the internal diameter of the inlet transfer device or inlet transfer reaction device 10 and the internal diameter of the restriction orifice or atmospheric pressure interface 19.

When the plume of target material or analyte is captured or otherwise retained within the inlet transfer device or inlet transfer reaction device 10 or when the plume of target material or analyte is arranged to be transmitted through the inlet transfer device or inlet transfer reaction device 10, the second or secondary laser 6 may then be fired or otherwise activated one or more times so as to generate a laser beam or one or more laser pulses 7 which are directed along at least a portion of the central portion of the inlet transfer device or inlet transfer reaction device 10.

In the embodiment shown in FIG. 1 the second laser beam or pulse(s) 7 are directed along the central portion or central axis of the inlet transfer device or inlet transfer reaction device 10 in a direction which is substantially counter to the direction of travel or flow of target material or analyte through the central portion or housing of the inlet transfer device or inlet transfer reaction device 10. However, other embodiments are contemplated wherein the orientation of the second laser source 6 or the direction of flow through the inlet transfer device or inlet transfer reaction device 10 may be reversed so that the second laser beam or pulse(s) 7 are directed along the central portion or central axis of the inlet transfer device or inlet transfer reaction device 10 in a direction which is substantially the same as the direction of travel or flow of target material or analyte through the central portion or housing of the inlet transfer device or inlet transfer reaction device 10.

A particularly beneficial aspect of the various embodiments is that there is arranged to be a substantial, increased, maximum, controllable or optimum overlap between the secondary laser beam or pulse(s) 7 and analyte and/or neutral particles and/or matrix and/or analyte or other ions so that the process of secondary activation is substantially enhanced, optimised or otherwise controlled.

Embodiments are contemplated wherein the degree of spatial overlap and/or the temporal extent of overlap between photons emitted from the secondary activation source or device and ions and/or neutral particles within the housing of the transfer device may be varied, altered or controlled. For example, during the course of an experimental run it may be desired to subject ions and/or neutral particles to different degrees of secondary activation. The intensity and mark/space ratio of photons emitted from the second laser 6 or other secondary activation device may be varied and numerous different modes of operation of the second laser 6 or other secondary device are contemplated.

Another beneficial aspect of the various disclosed embodiments is that the process of secondary activation may be performed by directing potentially harmful laser (or other) irradiation from the second laser source 6 (or other form of secondary activation device) away from the target sample and in particular away from the surface of the target sample. As a result, the various embodiments provide a safer way of performing secondary activation of e.g. ions and/or neutral particles and ensure that potentially dangerous pulses of laser radiation are kept away from the target sample which may comprise in vivo tissue or a living organism or from a user who may be in close proximity to the target sample.

Another beneficial aspect of the various embodiments is that there is no requirement or necessity to use conventional MALDI matrices (such as 2,5-dihydroxybenzoic acid ("DHB"), α-cyano-4-hydroxycinnamic acid ("CCA") or sinapinic acid ("SA") together with an organic base such as pyridine ("Py"), tributylamine ("TBA") or N,N-dimethylethylenediamine ("DMED")) with the sample surface. Accordingly, problems of chemical toxicity of the target sample can be avoided. For example, according to an embodiment IR MALDI may be performed wherein the matrix comprises water or another non-toxic or inert matrix. The non-toxic or inert matrix (e.g. water or another substance) may exist naturally within the sample or may be added in situ.

According to an embodiment the laser beam or pulse(s) 7 from the second laser source 6 (or photons from another secondary activation source or device) may be arranged so as to perform multiple internal reflections within the inlet transfer device or inlet transfer reaction device 10. Furthermore, high fluence focal points may be generated within the transfer capillary or transfer device 10 thereby further maximizing the overlap between analyte material or ions, optional matrix material or matrix ions and the secondary activation laser beam or pulse(s) 7.

According to an embodiment one or more matrices or other reagents may be introduced into the inlet transfer device or inlet transfer reaction device 10 via either the first supplementary inlet 13 and/or the second supplementary inlet 15. The one or more matrices or other reagents may be introduced into the inlet transfer device or inlet transfer reaction device 10 in order to enhance the ionisation of neutral particles within the inlet transfer device or inlet transfer reaction device 10 or to enhance another process or reaction or photo-activation effect within the inlet transfer device or inlet transfer reaction device 10.

Analyte ions and/or neutral particles and/or matrix or other ions within the inlet transfer device or inlet transfer reaction device 10 may also be subjected to other various reactions. For example, analyte ions and/or neutral particles may be subjected to fast photochemical oxidation of proteins ("FPOP") type reactions. Fast photochemical oxidation of proteins ("FPOP") is a chemical footprinting method whereby exposed amino-acid residues are covalently labelled by oxidation with hydroxyl radicals produced by the photolysis (i.e. photodissociation or photodecomposition) of hydrogen peroxide. Although oxidation via hydroxyl radicals induces unfolding in proteins on a time scale of milliseconds or longer, FPOP is designed to limit *OH exposure to 1 μs or less by employing a pulsed laser for initiation to produce radicals and a radical-scavenger to limit their lifetimes.

Gas-phase hydrogen/deuterium exchange ("HDX") reactions may also be performed within the inlet transfer device or inlet transfer reaction device 10. For example, gaseous $ND_3$ may be introduced into the inlet transfer reaction device 10 such that analyte ions undergo hydrogen/deuterium exchange as they mix with the $ND_3$ and pass towards the outlet 14 of the inlet transfer reaction device 10 and the inlet 19 of the mass spectrometer 17. The extent of deuterium labelling may be controlled by varying the quantity of $ND_3$ and/or the speed at which the analyte ions pass through the inlet transfer reaction device 10. Hydrogen/deuterium exchange of protein ions is highly sensitive to protein conformation and enables the detection of conformers.

According to an embodiment hydrogen/deuterium exchange reagents (gas or liquid) may be introduced via the first supplementary inlet 13 and/or via the second supplementary inlet 15. If an hydrogen/deuterium exchange reaction is performed within the inlet transfer device or inlet transfer reaction device 10 then the second laser source may either not be provided or may not be activated.

The second laser 6 may be used to provide de-clustering, photo-fragmentation, photo-activation or photo-dissociation of ions within the inlet transfer device or inlet transfer reaction device 10 by processes such as Electron Capture Dissociation ("ECD") and/or Electron Transfer Dissociation ("ETD") as a result of free electron generation. The fragment ions resulting from fragmentation, activation, declustering or dissociation processes such as Electron Capture Dissociation ("ECD") and/or Electron Transfer Dissociation ("ETD") may be mass analysed and may provide useful information which is helpful to confirm the precise identity of analyte ions.

Various embodiments are contemplated wherein ions and/or neutral particles are subjected to secondary activation and/or a reaction, fragmentation or dissociation process within the housing of an inlet transfer device or inlet transfer reaction device 10. Controlling the flow of gas, liquid or reagent into the first supplementary inlet 13 and/or into the second supplementary inlet 15 provides a way of changing the velocity of particles and/or ions passing along or through the inlet transfer device or inlet transfer reaction device 10. If the flow rate of particles and/or ions passing through the inlet transfer device or inlet transfer reaction device 10 is slowed down then the particles and/or ions may be subjected to a greater number of laser shots or laser pulses from the second laser 6 and hence may be subjected to a greater degree of secondary activation. Conversely, if the flow rate of particles and/or ions passing through the inlet transfer device or inlet transfer reaction device 10 is increased then the particles and/or ions may be subjected to a fewer number of laser shots or laser pulses from the second laser 6 and hence may be subjected to lesser degree of secondary activation. One or more electric fields may be applied across one or more regions or portions of the inlet transfer device or inlet transfer reaction device 10 in order to increase, decrease, vary or control the speed or transit time of charged particles or ions through the inlet transfer device or inlet transfer reaction device 10. Optionally, one or more transient DC voltages may be applied across or along one or more regions or portions of the inlet transfer device or inlet transfer reaction device 10 in order to increase, decrease, vary or control the speed or transit time of charged particles or ions through the inlet transfer device or inlet transfer reaction device 10. The flow rate of particles and ions through the inlet transfer device or inlet transfer reaction device 10 may also be controlled electro-mechanically by, for example, controlling the size of a restriction aperture and/or by diverting, controlling or directing flow through different paths through the inlet transfer device or inlet transfer reaction device 10.

Although the present invention has been described with reference to preferred embodiments, it will be understood by those skilled in the art that various changes in form and detail may be made without departing from the scope of the invention as set forth in the accompanying claims.

The invention claimed is:

1. An ambient or atmospheric pressure ion source comprising:

a first laser source arranged and adapted to generate ions and/or neutral particles from a target;

a transfer device arranged and adapted to cause said ions and/or said neutral particles to pass along a first path or axis within said transfer device, wherein said transfer device comprises a housing having an inlet through which said ions and/or said neutral particles enter said transfer device and an outlet through which said ions and/or further ions and/or neutral particles may exit said transfer device; and a secondary activation device which is arranged and adapted to direct laser radiation or photons along, across or over at least a portion of said first path or axis so as to cause secondary activation of said ions and/or said neutral particles.

2. An ambient or atmospheric pressure ion source as claimed in claim 1, wherein said transfer device comprises one or more capillaries, one or more heated capillaries, one or more tubular or hollow guides or one or more tubular or hollow optical fibres.

3. An ambient or atmospheric pressure ion source as claimed in claim 1, wherein said transfer device is selected from the group consisting of: (i) a drift tube; (ii) an ion mobility separator or spectrometer; (iii) a differential ion mobility separator or spectrometer or a Field Asymmetric Ion Mobility Spectrometry ("FAIMS") device; or (iv) a device for temporally separating ions and/or neutral particles according to a physico-chemical property.

4. An ambient or atmospheric pressure ion source as claimed in claim 1, wherein said housing comprises one or more optically transparent sections through which said laser radiation or photons pass.

5. An ambient or atmospheric pressure ion source as claimed in claim 1, wherein said transfer device further comprises one or more further inlets for introducing one or more reagents into said transfer device so that ions and/or neutral particles may be subjected to one or more reactions within said transfer device.

6. An ambient or atmospheric pressure ion source as claimed in claim 1, further comprising one or more detectors for detecting laser radiation or photons emitted from said secondary activation device before and/or during and/or after ions and/or neutral particles have been subjected to secondary activation within said transfer device.

7. An ambient or atmospheric pressure ion source as claimed in claim 1, wherein said secondary activation device comprises a laser source.

8. An ambient or atmospheric pressure ion source as claimed in claim 1, wherein said secondary activation device comprises a non-laser source of photons, one or more vacuum ultraviolet ("VUV") lamps, one or more light emitting diodes ("LEDs"), one or more visible photon sources or one or more infra-red ("IR) photon sources.

9. An ambient or atmospheric pressure ion source as claimed in claim 1, wherein said secondary activation comprises a process involving ionisation, secondary ionisation, further ionisation, photo-ionisation or post-ionisation of said ions and/or said neutral particles.

10. An ambient or atmospheric pressure ion source as claimed in claim 1, wherein said secondary activation device comprises an ionisation device, a secondary ionisation device, a further ionisation device, a photo-ionisation device or a post-ionisation device for ionising said ions and/or said neutral particles.

11. An ambient or atmospheric pressure ion source as claimed in claim 1, wherein said secondary activation comprises a process involving photofragmentation, photo-activation, photo-dissociation, fragmentation, activation, dissociation, Electron Capture Dissociation ("ECD"), Electron Transfer Dissociation ("ETD"), declustering, reacting, fast photochemical oxidation of proteins ("FPOP") reactions or hydrogen/deuterium exchange ("HDX") reactions of said ions and/or said neutral particles.

12. An analytical device comprising an ambient or atmospheric pressure ion source as claimed in claim 1.

13. An analytical device as claimed in claim 12, wherein said analytical device comprises an ion mobility spectrometer or separator, a differential ion mobility spectrometer or separator or a mass spectrometer.

14. An analytical device as claimed in claim 12, wherein said analytical device further comprises an atmospheric pressure interface and wherein said transfer device is arranged and adapted to direct ions/or neutral particles towards said atmospheric pressure interface.

15. A method of generating ions at ambient or atmospheric pressure comprising:

directing emission from a first laser source at a target in order to generate ions and/or neutral particles;

transmitting said ions and/or neutral particles along a first path or axis within a transfer device, wherein said transfer device comprises a housing having an inlet through which said ions and/or said neutral particles enter said transfer device and an outlet through which said ions and/or further ions and/or neutral particles may exit said transfer device; and directing laser radiation or photons along, across or over at least a portion of said first path or axis so as to cause secondary activation of said ions and/or said neutral particles.

16. A method of analysis comprising a method of generating ions as claimed in claim 15.

* * * * *